US005950267A

United States Patent [19]

Ricci, Jr.

[11] Patent Number: 5,950,267

[45] Date of Patent: Sep. 14, 1999

[54] PORTABLE GANGWAY WITH LEVELING STAIRS

[76] Inventor: Patrick J. Ricci, Jr., 2604 NW. 2nd Ave., Boca Raton, Fla. 33431

[21] Appl. No.: 08/944,656

[22] Filed: Oct. 6, 1997

[51] Int. Cl.[6] ..... E04F 11/04

[52] U.S. Cl. ..... 14/71.1; 52/183; 182/1; 182/97

[58] Field of Search ..... 14/69.5, 71.1, 14/71.5; 52/182, 183; 182/1, 97

[56] References Cited

U.S. PATENT DOCUMENTS

| | | |
|---|---|---|
| 298,212 | 5/1884 | Knight . |
| 1,419,834 | 6/1922 | Fellows . |
| 3,731,761 | 5/1973 | Glenn . |
| 4,168,764 | 9/1979 | Walters . |
| 4,539,781 | 9/1985 | McCoy . |
| 4,959,935 | 10/1990 | Stob . |
| 4,971,168 | 11/1990 | Stanescu . |

*Primary Examiner*—James A. Lisehora
*Attorney, Agent, or Firm*—Robert M. Downey, P.A.

[57] ABSTRACT

A gangway to accommodate passage to and from a boarding structure includes first and second longitudinal frame members each having an elongate housing with a wall structure surrounding an interior thereof and a pair of longitudinal elongate rails extending through a length of the housing in parallel relation to each other and terminating at opposite distal ends; the pair of rails including a fixed rail and a moving rail. A series of step members, each including top bottom step surfaces, are rotatably supported between the first and second longitudinal frame members in pivotal interconnection with the pair of rails of each frame member. Mounting platforms attach to the distal ends of the rails and enable one end of the gangway to move through an arc of movement relative to an opposite fixedly mounted end, thereby causing movement of the moving rails relative to the fixed rails, within each frame member, resulting in synchronized rotation of the step members so that the top and bottom step surfaces of the step members remain horizontal and level upon a change in an upward or downward angle of the gangway. Handrails are removably attachable to the gangway along the outboard sides of the longitudinal frame members and include articulating joints to permit angular movement of the handrails with the gangway.

8 Claims, 7 Drawing Sheets

PORTABLE GANGWAY WITH LEVELING STAIRS

BACKGROUND OF THE INVENTION

1. Field of the Invention

The present invention relates to portable gangways, stairways, ladders and the like. More particularly, the present invention relates to a portable gangway having a series of steps and means for maintaining the steps horizontal and level as an angle of inclination of the gangway is varied.

2. Description of the Related Art

The need to walk or travel from one floor, platform level, or deck to another is encountered by most people throughout the course of their daily excursions. When two or more levels are fixed as a permanent structure and do not move relative to one another, a fixed structure such as a stairway, escalator and/or elevator are often employed as a means to facilitate convenient and safe passage between the two or more levels. In other instances, the various levels may be mobile or transitory, and thus a fixed structure is not practical. Still, in other situations, two platform levels or deck surfaces may constantly move relative to one another. A boat rising and lowering with the tide relative to a dock is an example of this type of a situation. In these instances, wherein a fixed structure such as a stairway is not practical, ladders, planks, ramps, and remote gangways are typically used so that persons can walk or climb from one deck surface level to another.

In the past, ladders, gangways, and ramps have proven to be awkward, especially when at least one of the deck surfaces is moving. Many times, the angle of inclination of a ramp or ladder make it dangerous, if not impossible, to traverse between two deck surfaces or platforms. For instance, when the angle of inclination of a ladder becomes more horizontal, the top step surfaces become awkwardly angled, requiring a person to step on the edge of the step, rather than the top surface. On the other hand, a ramp becomes too difficult to travel when it reaches angles of inclination of 40° of greater, becoming more vertically inclined.

In an effort to accommodate for varying heights and distances between two platform or deck surfaces, various adjusting stairways, gangways, and ladders have been proposed in the related art. Many of these proposed structures are cumbersome, heavy and not easily transported for use at various locations. Further, some of these proposed adjusting and/or portable ladders have been known to collapse while people are traversing or transporting them causing serious injury. The proposed structures in the prior art all fail to provide a convenient, safe, portable and lightweight yet sturdy gangway having a series of steps which continually adjust so that a top flat step surface of each of the steps remains level as the angle of inclination of the gangway changes while also providing means to protect the user from moving parts that sometimes cause injury.

OBJECTS AND ADVANTAGES OF THE PRESENT INVENTION

It is a primary object of the present invention to provide a portable, lightweight gangway which is structured to provide a safer, more versatile means to travel between two platform surfaces of varying heights, angles, and/or distances that otherwise make passage difficult or dangerous.

It is another object of the present invention to provide a portable, lightweight and sturdy gangway having a plurality of steps and means for automatically adjusting the steps so that the top and bottom step surfaces of each of the steps remain level at a preferred horizontal orientation as the angle of inclination of the gangway varies.

It is still a further object of the present invention to provide a gangway having a series of adjusting steps, wherein the top and bottom step surfaces of each of the steps remain level as the angle of inclination of the gangway is moved through a range of approximately 90° and wherein the gangway can be flipped over to use the bottom step surfaces and to thereby permit use of the gangway for upward and/or downward deployment through a range of angular movement of approximately 180°.

It is still a further object of the present invention to provide a gangway which includes means to accommodate passage of a wheelchair therealong throughout a range of angles of inclination.

It is still a further object of the present invention to provide a portable, lightweight gangway having the advantages as set forth above and which is useful for numerous applications including: shore to vessel passage; as a drop ladder for attics; a mobile ladder mounted to a truck for drive up boarding (as in airport applications); as a fire escape; ground to aircraft passage; fire trucks and boom trucks; as a temporary construction walkway ramp; as well as numerous other applications.

SUMMARY OF THE INVENTION

The present invention is directed to a gangway to accommodate passage to and from a boarding structure and includes first and second longitudinal frame members each having an elongate housing with a wall structure surrounding an interior of the housing. A pair of longitudinal elongate rails extending through a length of the housing in parallel relation to each other terminate at opposite distal ends, beyond the opposite ends of the housing; the pair of rails including a fixed rail and a moving rail. A series of step members, each including top and bottom step surfaces, are rotatably supported between the first and second longitudinal frame members in pivotal interconnection with the pair of rails of each frame member. Mounting platforms attach to the distal ends of the rails and enable one end of the gangway to move through an arc of movement relative to an opposite fixedly mounted end, thereby causing movement of the moving rails relative to the fixed rails, within each frame member, and synchronized rotation of the step members so that the top and bottom step surfaces of the step members remain horizontal and level upon a change in an angle of inclination of the gangway. Safety rails are removably attachable to the gangway along the outboard sides of the longitudinal frame members and include articulating joints to permit movement of an elongate handrail relative to mounting posts as the angle of the gangway changes.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figures 1, 3:
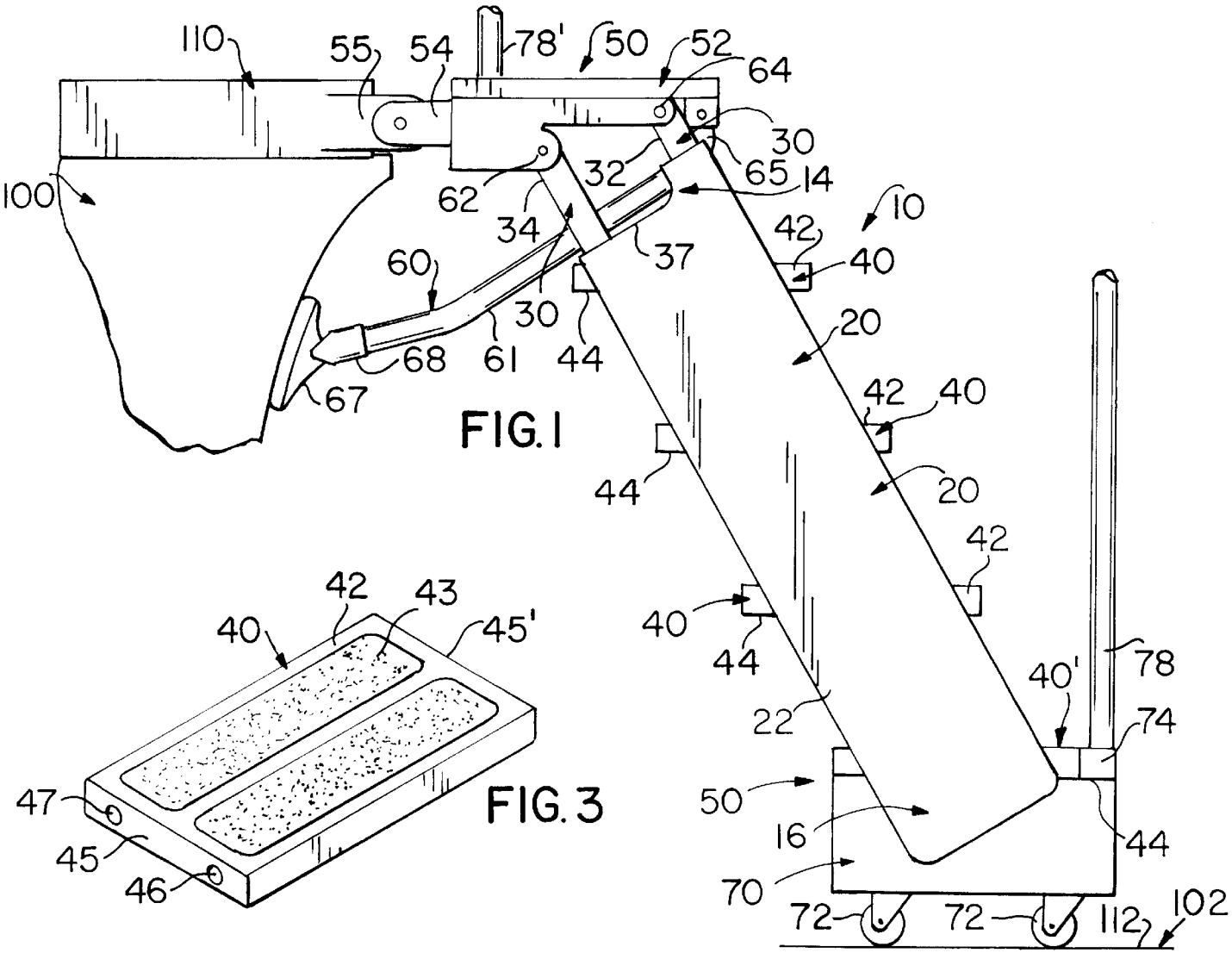
FIG. 1 is a side elevational view showing the portable gangway of the present invention mounted to the deck of a vessel, or like boarding structure, and disposed in a downwardly deployed operative position from the vessel to a dock or like landing surface.
FIG. 3 is an isolated perspective view of a step of the portable gangway.

Referring to the several views of the drawings, the portable gangway of the present invention is shown and is generally indicated as 10. The gangway 10 is structured to accommodate passage between a boarding structure 100, such as a boat, to a landing structure 102, such as a dock. It should be noted, however, that the portable gangway 10 can be used to accommodate passage between virtually any two structures including, but not limited to: passage between a fixed pier and a floating dock; passage between two floors of a house or building; as a boarding stairway for passage between a landing structure and an aircraft; or as a fire escape.

The gangway 10 includes a main frame assembly 12 having opposite distal ends, including a first distal end 14 and a second distal end 16. The main frame assembly 12 includes a pair of longitudinal frame members 20, 20' which extend a length of the main frame assembly 12, between the opposite distal ends 14, 16, in spaced, parallel relation to one another. Each of the longitudinal frame members 20, 20' includes a housing which extends substantially along a length of the frame member; the housing 22 including an inboard facing side wall 24, a top wall 25, a bottom wall 26, and an outboard cover 27. The walls of the housing surround and enclose an interior 28 which accommodates a pair of longitudinal, elongate rails 30, including a fixed rail 32 and a moving rail 34. The rails extend through a length of the housing and exit at the one end 37 of the housing, to expose distal ends 36, 36' of the rails 30.

Figure 10:
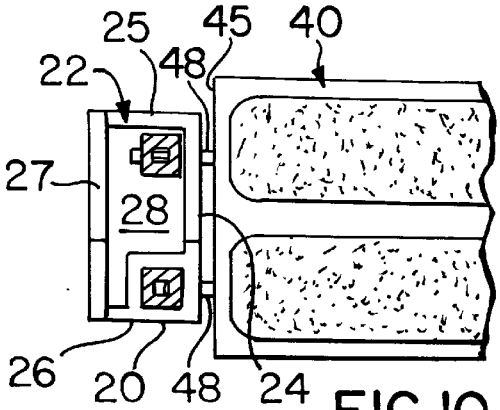
FIG. 10 is an end elevation, in partial cutaway, showing the assembled housing of one of the longitudinal frame members and a step pivotally interconnected thereto.
Figure 11:
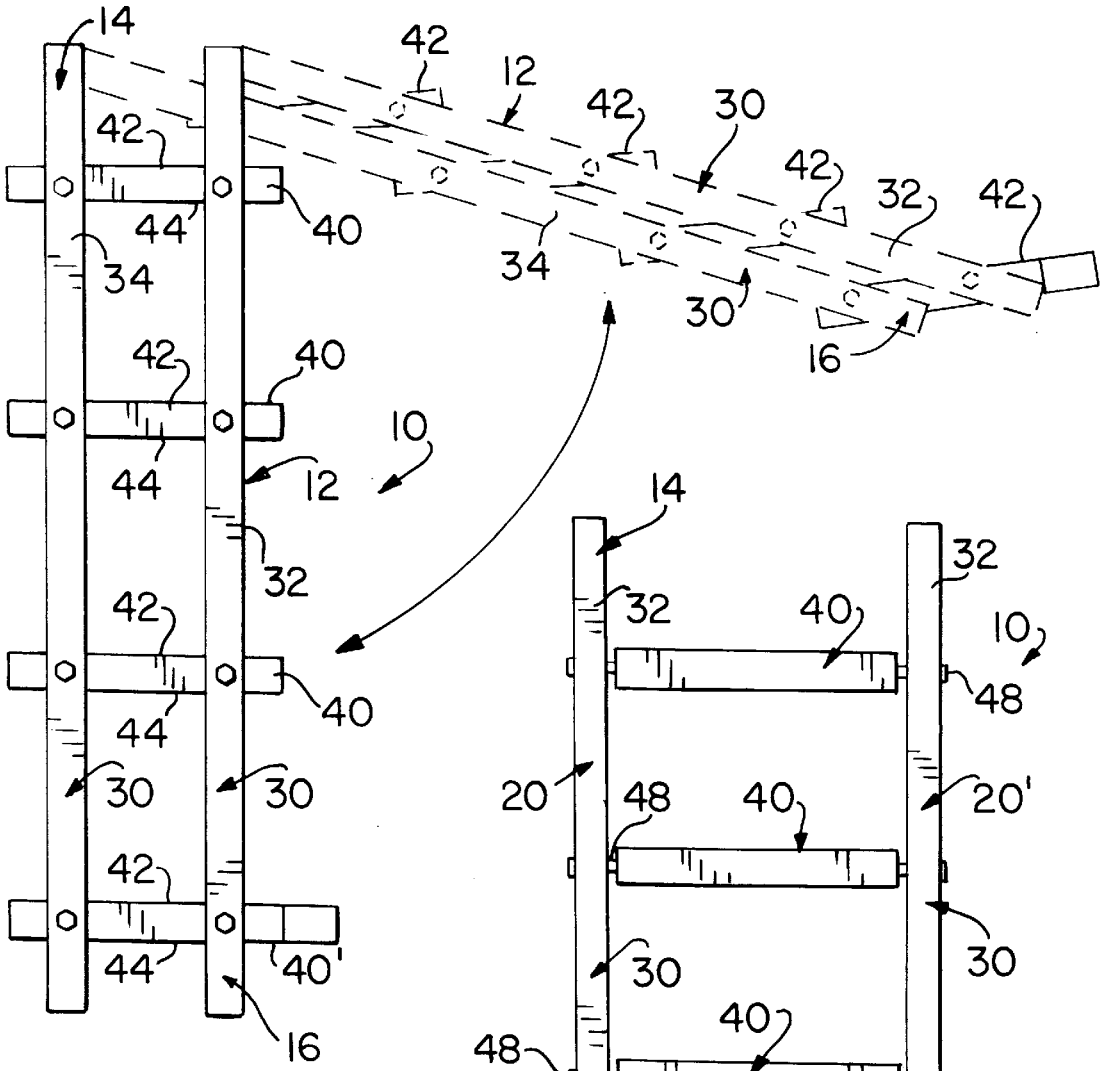
FIG. 11 is a diagrammatic illustration showing movement of longitudinal rails of the frame members relative to the steps throughout an arc of movement of the gangway.
Figure 12:
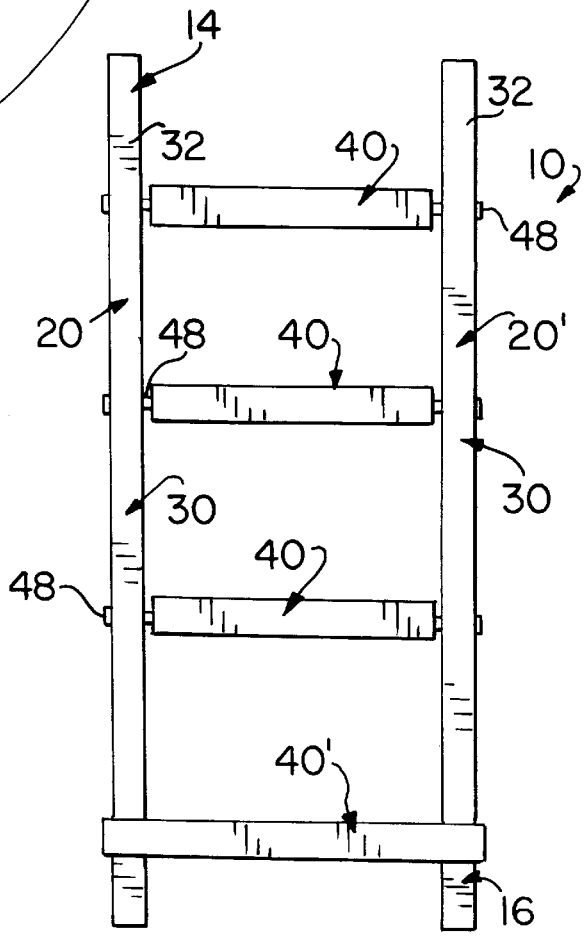
FIG. 12 is a front elevational view of the longitudinal rails and steps pivotally interconnected thereto, with the housings of each of the frame members removed.
Figure 13:
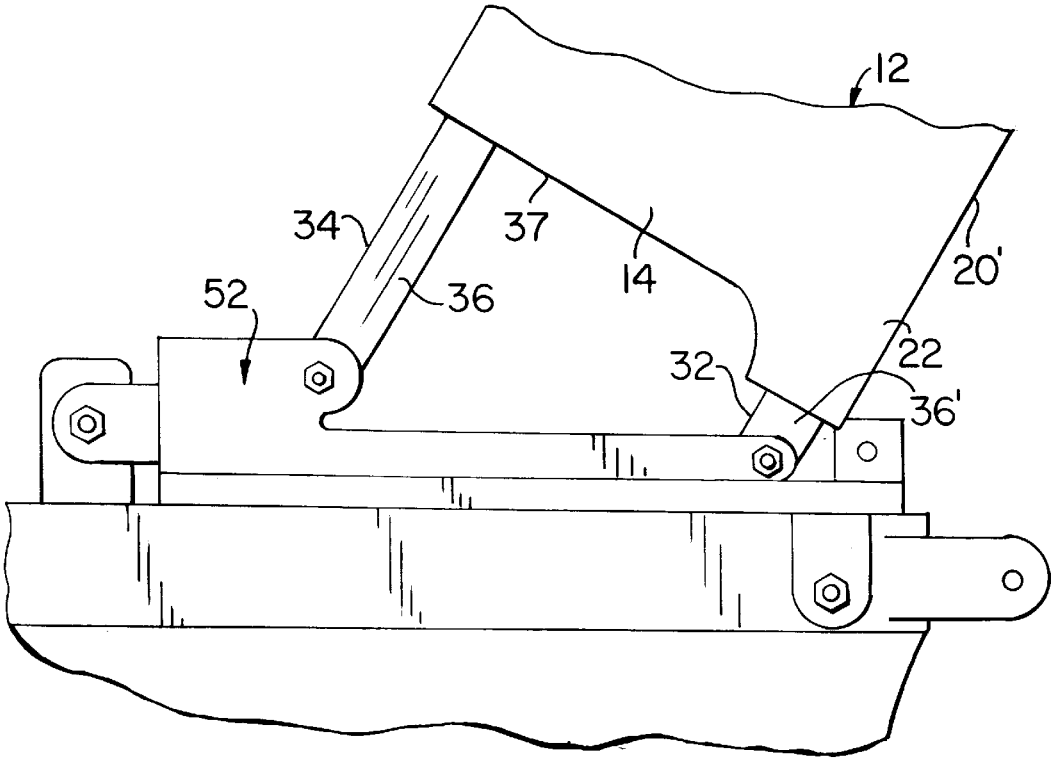
FIG. 13 is an isolated elevational view of one end of the frame member shown interconnected to a mounting platform on the deck of a vessel or like boarding structure when in the upwardly deployed orientation.
Figure 14:
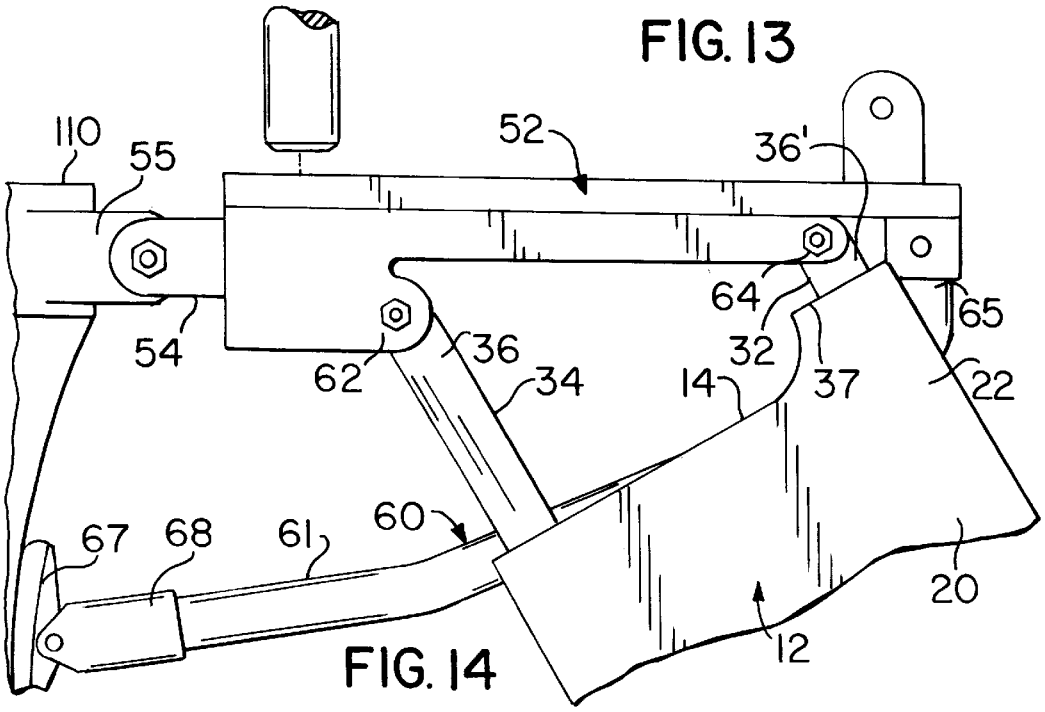
FIG. 14 is an isolated elevational view of the end of the frame member shown mounted to the platform in an inverted position when in the downwardly deployed orientation.

A plurality of step members 40 are rotatably mounted and supported in transverse extending relation between the longitudinal frame members 20, 20'. Referring to FIG. 3, each of the step members 40 includes a top step surface 42 and an opposite bottom step surface 44 (see FIGS. 1 and 2) which is identical to the top surface. The top and bottom step surfaces 42, 44 are preferably provided with traction means 43, such as a non-slip texture or a wood panel surface. Opposite end faces 45, 45' of each step member 40 are provided with means for pivotal attachment to the fixed and moving rails of each longitudinal frame member. In a preferred embodiment, the end faces 45, 45' are provided with holes 46, 47 for receipt and through passage of a respective transverse axle 48. Opposite distal end zones of the through axles 48 are rotatably fitted through the fixed and moving rails, as best seen in FIGS. 10–12. In this manner, each of the steps 40 is rotatably supported on two of the transverse axles 48, each extending transversely through the steps, in parallel relation, so that the steps are rotatable relative to the axles as well as the rails of each longitudinal frame member 20, 20'. Thus, as best seen in FIG. 11, as one distal end 16 of the frame assembly 12 moves through an arc relative to the other distal end 14, which remains fixed, the moving rails are caused to move closer to the fixed rails, in a scissor type effect, as the top and bottom step surfaces remain horizontal and level.

The housing 22 of each longitudinal frame member 20, 20' is fitted in covering relation to the fixed 32 and moving 34 rails so that the inboard facing wall 24 of the housing is positioned between the rails and the end faces 45, 45' of the step members 40. Accordingly, the housing serves to protectively conceal the rails 32, 34 so that a person or object does not become pinched between the rails as the moving rail 34 moves relative to the fixed rail 32. The inboard facing side walls of the housings are provided with curvilinear slots 49 in order to accommodate for movement of the transverse axle 48 attached to each of the moving rails of the oppositely disposed frame members, as the moving rails move towards the fixed rails as the angle of inclination of the gangway changes. Accordingly, as the moving rail is caused to be moved relative to the fixed rail, the transverse axle fitted to the moving rail travels along the respective curvilinear slot 49 formed in the inboard facing side wall of the housing to maintain the respective step member horizontal and level.

Mounting means 50 are provided for securing the opposite distal ends 14, 16 of the main frame assembly 12 between the boarding structure 100 and the landing structure 102. Specifically, a mounting platform 52 is structured for fixed mounting to the boarding structure 100 to accommodate pivotal mounting of the end 14 of the frame assembly 12 thereto in both the downwardly and upwardly deployed orientations. In the downwardly deployed orientation, the mounting platform is secured outboard of the deck 110 of the boarding structure 100 by bolts and/or other conventional hardware fitted through mating flanges 54, 55. A brace 60 supports the mounting platform when overhanging the deck 110 and includes a Y-shaped bar 61 fitted at one end 65 to the under side of the mounting platform and having pad means 67 at an opposite end for engaging a vertical outboard surface of the boarding structure. The pad means is preferably pivotally fitted to the end of the Y-shaped bar to facilitate angular adjustment relative to the mating outboard surface. A threaded coupling 68 is adjustably fitted on the end of the Y-shaped bar to facilitate adjustment of the length of the brace 60 between the end 65 and the pad means 67, thereby accommodating for varying distances between the outboard vertical surface and the point of attachment of the brace at the under side of the mounting platform.

Figures 2, 4:
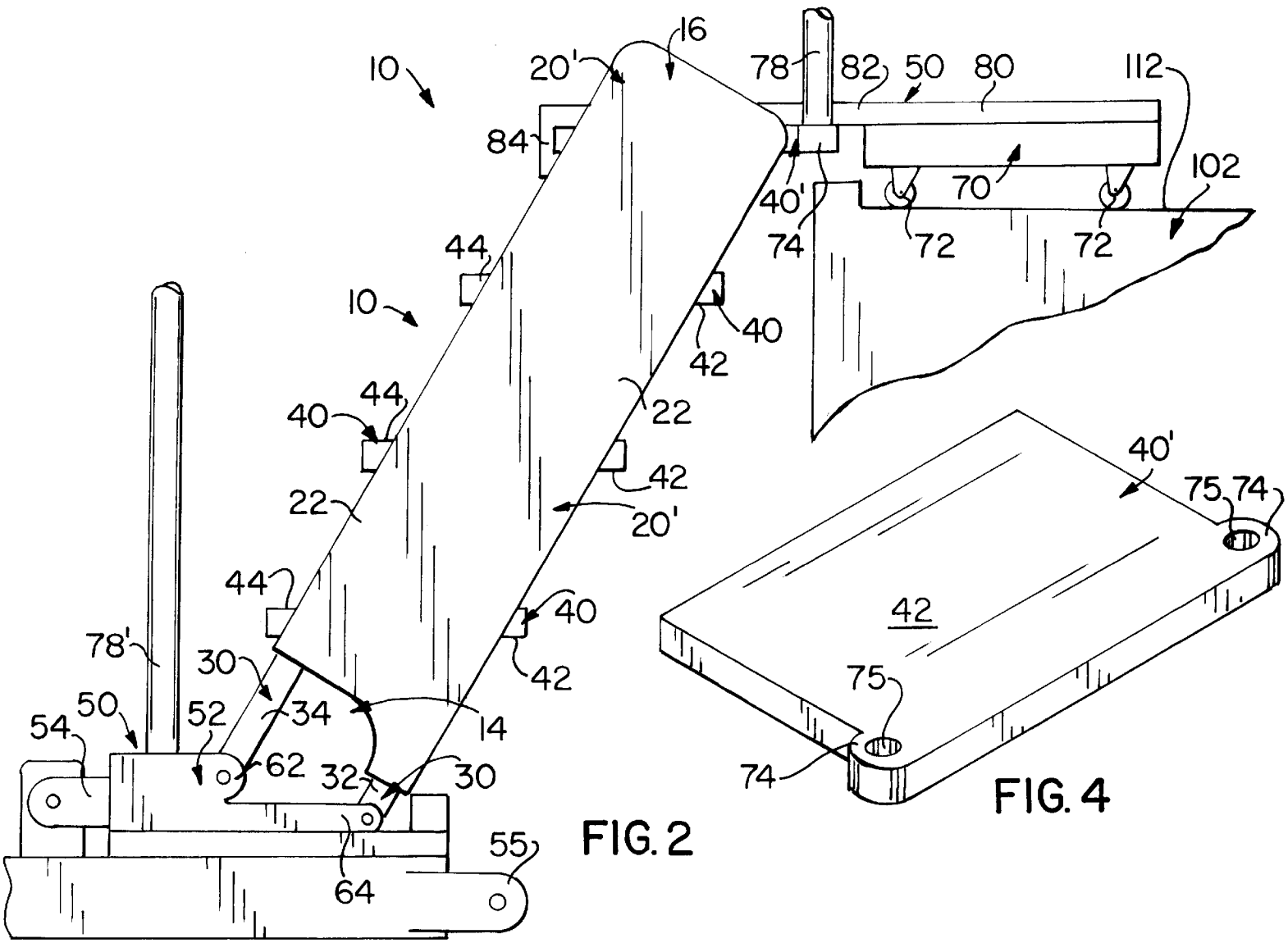
FIG. 2 is a side elevational view of the portable gangway disposed in an upwardly deployed position from the deck of a vessel, or like boarding structure, to a dock or like landing surface.
FIG. 4 is an isolated perspective view of an end step of the gangway.
Figure 6:
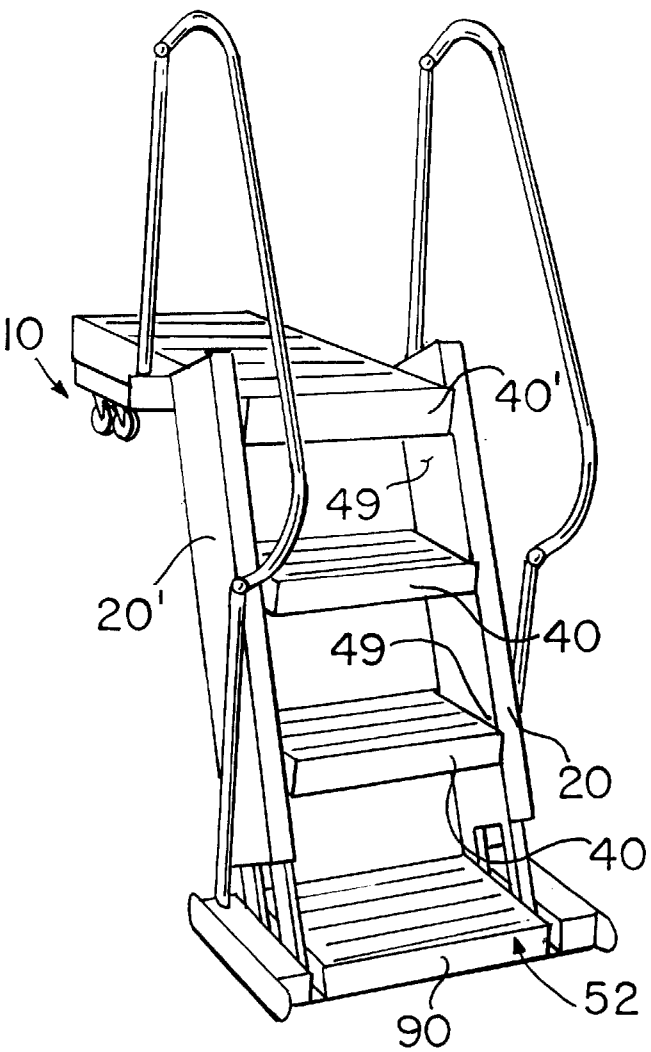
FIG. 6 is a front perspective view of the gangway shown in the upwardly deployed position of FIG. 2.
Figure 5:
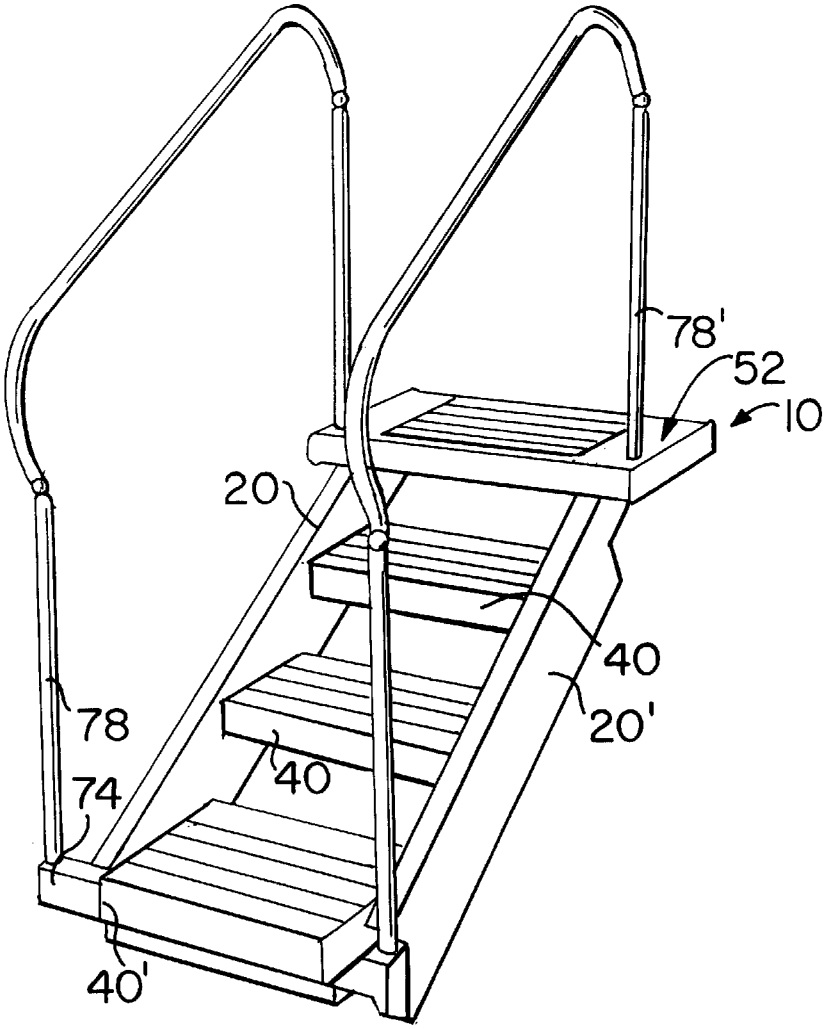
FIG. 5 is a front perspective view of the gangway shown in the downwardly deployed position of FIG. 1.
Figure 9:
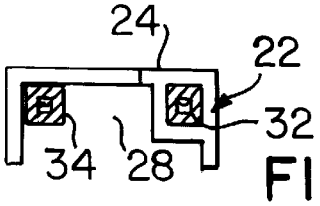
FIG. 9 is an end elevation, in partial section, of the housing interior of FIG. 7.
Figure 8:
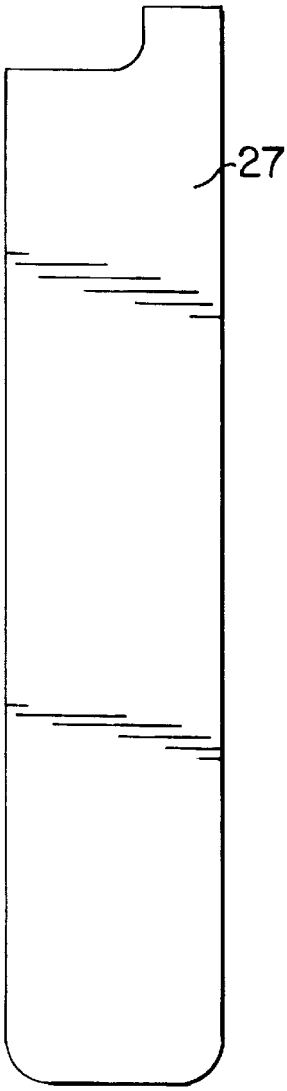
FIG. 8 is a plan view of a cover of the housing.
Figure 7:
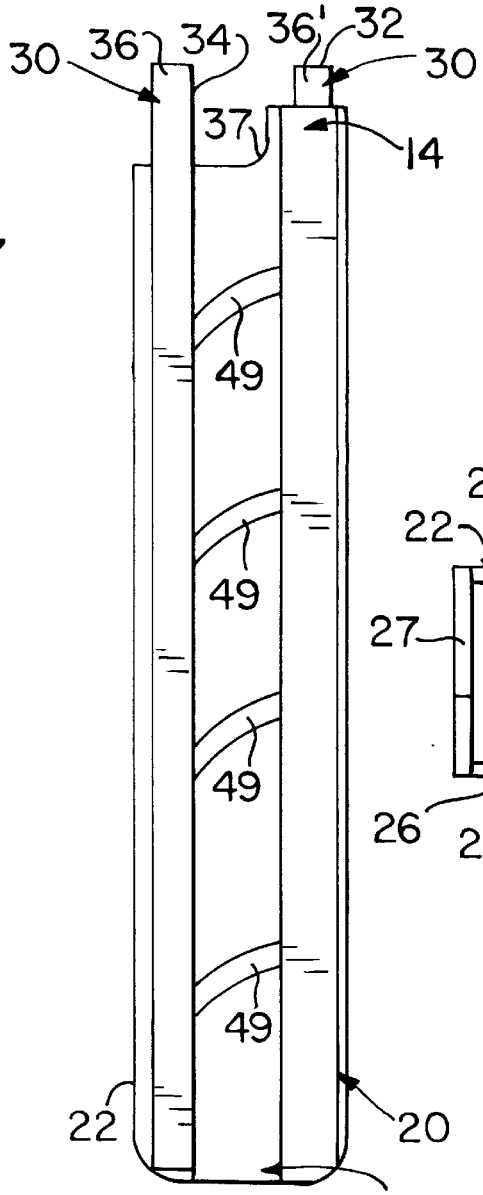
FIG. 7 is a plan view of an interior of the housing of a longitudinal frame member.

The longitudinal frame members 20, 20' pivotally attach to the mounting platform 52 to permit swinging movement of the gangway 10 relative to the mounting platform. Specifically, the distal ends 36, 36' of the fixed and moving rails 32, 34 pivotally attach to the under side of the mounting platform at positions 62, 64, as seen in FIG. 1. Upon angular movement of the gangway through an arc of travel, as the boarding structure (e.g., a boat) moves vertically relative to the landing surface, the top and bottom step surfaces 42, 44 of the step members 40 remain horizontal and level, as described above. The opposite end 16 of the main frame assembly 12 is provided with moving mounting means to permit movement of the end 16 of the gangway 10 relative to the landing surface 112. In the preferred embodiment, the moving mounting means includes a dolly 70 or like structure having swivel wheels 72 mounted to a bottom thereof. In the downwardly deployed orientation, as seen in FIG. 1, the dolly 70 mounts to a bottom surface of the last step member 40' which is specifically structured and configured for mating attachment with the top of the dolly. To secure the dolly to the step, lock pins or like means are fitted through the step and into the dolly. Referring to FIG. 4, the step 40' is shown in FIG. 4 and includes opposite ears 74 which extend outwardly and include through hole means 75 for receipt of a lower end zone of a safety rail mounting post 78. Through hole means 53 in mounting platform 52 receive a lower end zone of mounting post 78' at an opposite end of the safety rail 52.

In the upwardly deployed orientation, as seen in FIG. 2, the mounting platform is inverted and placed on the deck surface 110 of the boarding structure 100. The main frame assembly 12, mounted to the platform, in the same manner as described above, extends upwardly so that the bottom step surfaces 44 of the step members 40, 40' are oriented in an upward facing manner for stepping thereon. The step 40' mounts to the top of dolly 70 using an extension member 80 which has a flat plate 82 which fits over the bottom surface of the step member 40' and a catch means 84 at an end of the plate 82 which is structured to fit partially around an end of step 40' and under the top surface to effectively grab the step member 40'. The extension member 80 further mounts to the top of the dolly 70 using lock pins or other suitable means for releasable attachment. Accordingly, as the angle of inclination of the gangway 10 changes, the top and bottom surfaces of the step members 40, 40' remain horizontal and level as the dolly is able to move along the landing surface 112 of the landing structure 102.

Figure 15:
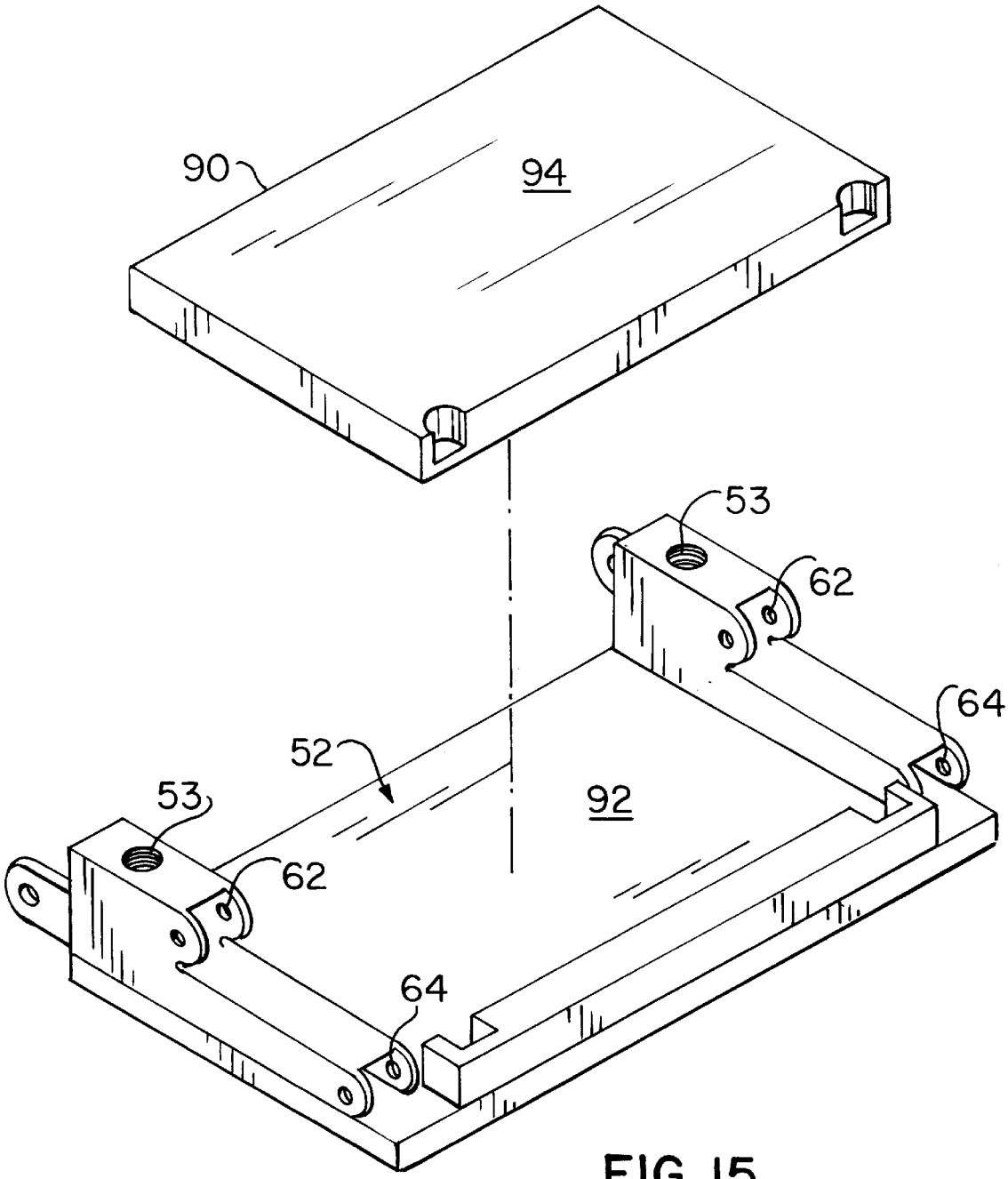
FIG. 15 is an exploded perspective view of the mounting platform and a step insert.

A step insert 90 is fitted to the under side 92 of the mounting platform 52 to provide a uniform, level surface 94 when the platform 52 is in the inverted position, as seen in FIGS. 2 and 15. In this manner, a suitable bottom step surface is provided on the under side of the mounting platform to avoid tripping on the structure surrounding the under side 92 of platform 52.

While the instant invention has been shown and described in what is considered to be a preferred and practical embodiment thereof, it is recognized that departures may be made within the spirit and scope of the present invention which, therefore, should not be limited except as set forth in the following claims as interpreted under the doctrine of equivalents.

Now that the invention has been described,

What is claimed is:

1. A gangway to accommodate passage to and from a boarding structure, comprising:

a main frame assembly having opposite distal ends defining a length of said main frame assembly therebetween, and said main frame assembly further including first and second longitudinal frame members each including an elongate housing having a wall structure, including an inboard facing side wall, surrounding an interior of said housing;

a plurality of step members each including top and bottom step surfaces and opposite ends;

means for rotatably supporting said step members transversely between said longitudinal frame members at spaced intervals between said opposite distal ends of said main frame assembly and including a pair of transverse axles rotatable received through each of said step members in spaced, parallel relation and rotatable fitted to said longitudinal frame members at respective opposite distal end zones of said transverse axle;

said inboard facing side walls of said housings of said first and second longitudinal frame members being positioned and disposed in spaced, adjacent relation to said respective opposite ends of said plurality of step members and said inboard facing side walls including means formed therethrough for passage of said transverse axles therethrough including an array of curvilinear slots disposed in equi spaced intervals along a length of said inboard facing side walls, said curvilinear slots being structured and disposed to accommodate receipt and movement of said transverse axles relative to said inboard facing side walls;

mounting means for pivotally mounting a first of said opposite distal ends of said main frame assembly to the boarding structure so that a second of said opposite distal ends is able to swing through an arc of movement relative to said first distal end; and drive means for synchronized rotating of said step members relative to said main frame assembly so that said top and bottom step surfaces of each of said step members remain horizontal and level upon a change in an angle of inclination of said main frame assembly as said second distal end of said main frame assembly travels through said arc of movement relative to said first distal end.

2. A gangway as recited in claim 1 wherein said first and second longitudinal frame members further include a pair of longitudinal elongate rails extending within said housing interior and terminating at opposite distal ends, defining said opposite distal ends of said main frame assembly, said pair of longitudinal elongate rails including a fixed rail and a moving rail disposed in parallel relation to each other.

3. A gangway as recited in claim 2 wherein said means for rotatably supporting said step members includes pivot means for pivotally attaching said opposite ends of said step members to said fixed and moving rails of each of said first and second longitudinal frame members so that step members are rotatably supported transversely between said first and second longitudinal frame members at spaced intervals between said first and second opposite distal ends of said main frame assembly.

4. A gangway as recited in claim 1 wherein said mounting means includes a platform structured for fixed mounting to the boarding structure and including means for pivotal attachment of said distal ends of said fixed and moving rails of said first and second longitudinal frame members.

5. A gangway as recited in claim 4 wherein said mounting means further includes dolly means removably attachable to said gangway opposite of said mounting platform, for rolling movement along a landing surface as said second distal end of said main frame assembly travels through said arc of movement relative to said first distal end.

6. A gangway as recited in claim 5 further including means for removably attaching said dolly means to one of said step members.

7. A gangway as recited in claim 1 further including handrail assemblies removably attachable to said gangway and extending longitudinally along outboard sides of said gangway in parallel relation to said first and second longitudinal frame members.

8. A gangway to accommodate passage to and from a boarding structure, comprising:

a main frame assembly including first and second longitudinal frame members each including:

an elongate housing having a wall structure, including an inboard facing side wall, surrounding and enclosing an interior of said housing;

a pair of longitudinal elongate rails extending within said housing interior and terminating at opposite distal ends defining first and second opposite distal ends of said main frame assembly, and including a fixed rail and a moving rail disposed in parallel relation to each other;

a plurality of step members each including top and bottom step surfaces and opposite ends;

pivot means for pivotally attaching said opposite ends of said step members to said fixed and moving rails of each of said first and second longitudinal frame members so that said step members are rotatably supported transversely between said first and second longitudinal frame members at spaced intervals between said first and second opposite distal ends of said main frame assembly, said pivot means including a pair of transverse axles rotatable received through each of each said step members in spaced, parallel relation and being rotatable fitted to said fixed and moving rails of each of said longitudinal frame members at respective opposite distal end zones of said transverse axles;

said inboard facing side walls of each said housings of each of said longitudinal frame members being positioned and disposed between a respective one of said opposite ends of said step members and said fixed and moving rails of a respective one of said first and second longitudinal frame members;

said inboard facing side walls further including means formed therethrough for passage of said transverse axles and including an array of curvilinear slots disposed in equi spaced intervals along a length said inboard facing side walls to accommodate receipt and movement of said transverse axles relative to said inboard facing side walls; and mounting means for pivotally mounting said first distal end of said main frame assembly to said boarding structure so that said second distal end of said main frame assembly is able to swing through an arc of movement relative to said first distal end to cause movement of said moving rail relative to said fixed rail and synchronized rotation of said step members so that said top and bottom step surfaces of each of said step members remain horizontal and level upon a change of angle of inclination of said main frame assembly, as said second distal end of said main frame assembly travels through said arc of movement relative to said first distal end.

* * * * *